United States Patent [19]

Poncin

[11] 4,455,771

[45] Jun. 26, 1984

[54] SHOVEL EXCAVATOR BUCKET TEETH

[76] Inventor: André Poncin, Route de Warnécourt, 08000 Prix Les Mezieres, France

[21] Appl. No.: 517,934

[22] Filed: Jul. 29, 1983

Related U.S. Application Data

[63] Continuation of Ser. No. 347,712, Feb. 10, 1982, abandoned.

[30] Foreign Application Priority Data

Feb. 16, 1981 [FR] France ..... 81 02972

[51] Int. Cl.[3] ..... E02F 9/28

[52] U.S. Cl. ..... 37/142 A; 403/379

[58] Field of Search ..... 37/142 R, 142 A, 141 T; 403/378, 379, 324

[56] References Cited

U.S. PATENT DOCUMENTS

| | | | |
|---|---|---|---|
| 2,936,538 | 5/1960 | Opsahl | 37/142 A |
| 3,025,619 | 3/1962 | Towne et al. | 37/142 A |
| 3,106,256 | 10/1963 | McBride | 37/142 A X |
| 3,256,622 | 6/1966 | Hostettes | 37/142 A |
| 4,182,058 | 1/1980 | Poncin | 37/142 A |

*Primary Examiner*—Edgar S. Burr
*Assistant Examiner*—Moshe I. Cohen
*Attorney, Agent, or Firm*—Watson, Cole, Grindle & Watson

[57] ABSTRACT

A curvilinear resilient pin for securing a tooth to the bucket of an excavating device includes a plurality of waves or undulations formed along its surface. The pin is inserted into a channel formed through a tooth support upon which the tooth is mounted as well as through apertures formed in the tooth. The waves or undulations contact and exert pressure upon the tooth and the tooth support so as to laterally restrain the pin within the channel.

2 Claims, 2 Drawing Figures

1
2
3
3a
3b
4
4a
5
6
6a
7
7b
8
9
10
11
12
13
f

SHOVEL EXCAVATOR BUCKET TEETH

This application is a continuation, of application Ser. No. 347,712, filed Feb. 10, 1982 now abandoned.

BACKGROUND OF THE INVENTION

1. Field of the Invention

This invention relates generally to excavator bucket teeth and more particularly to a pin for mounting the teeth on the bucket.

2. Description of the Prior Art

In U.S. Pat. No. 4,182,058 filed on Jan. 4, 1978 is disclosed a removable tooth fixation device for a shovel excavator bucket or a similar device, comprising a fixed support provided with nose on which is controlled a hollow and removable wear-resisting tooth, maintained on the nose through a resilient steel pin extending through a curved passage and provided at each of its ends with means maintaining it in position so as to avoid its being driven out from its housing during use.

SUMMARY OF THE INVENTION

The object of the present addition is to provide improvements to the mounting of a removable tooth on an excavator bucket with a resilient steel pin, in order to enhance the fit of the pin in its housing. The improvement consists in providing the pin with an undulating or wavy configuration so that it can come to rest resiliently on the side walls of its housing.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts through the several views and wherein.

DETAILED DESCRIPTION OF THE PREFERRED EMBODIMENT

Figures 1, 2:
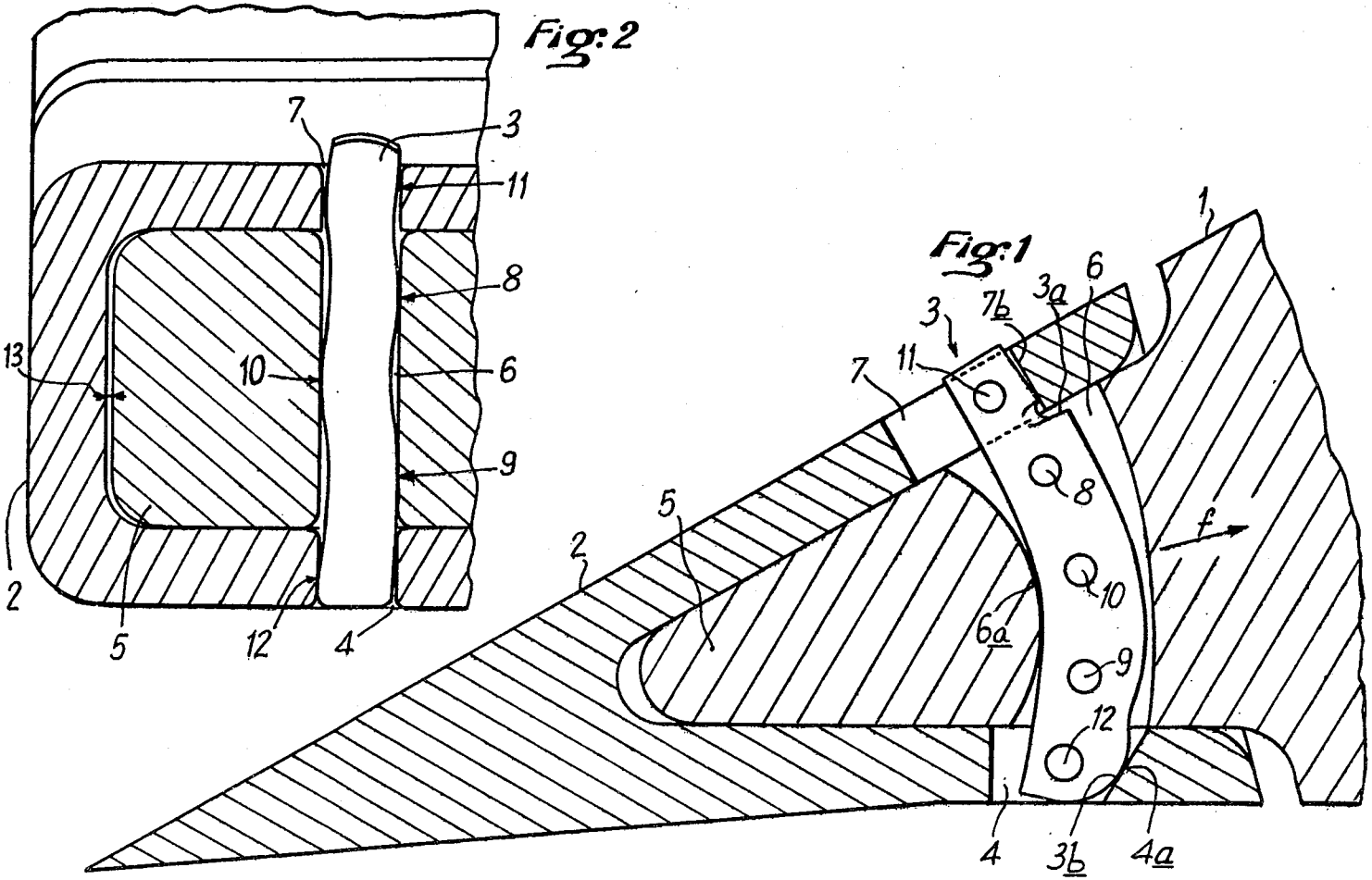
FIG. 1 is a sectional view of a tooth provided with an improved pin according to the invention.
FIG. 2 is a front section view of FIG. 1.

Reference being made to FIGS. 1 and 2, it is seen that, as discussed in the main U.S. Pat. No. 4,182,058, the tooth comprises a support 1 having at its front portion a nose 5 onto which is threaded a hollow tooth 2, a curvilinear channel 6 extending through the support having side walls and front and rear walls and having both ends corresponding with apertures 4 and 7 formed through tooth 2. A pin 3 having a crescent-shaped cross section extends through both apertures 4 and 7 and housing 6. The pin 3, which is resilient, bears against the nose 5 at point 6*a* and against the front wall of channel 6 of walls 4*a* and 7*b* of apertures 4 and 7 such that tooth 2 is permanently urged in the direction of arrow f, thereby maintaining tooth 2 in position. The locking of pin 3 in position is provided by a shoulder 3*a* formed on pin 3, which fits under the edge of aperture 7, and by a bulging surface 3*b* formed at the other end of pin 3, resting against the slanting wall 4*a* of aperture 4.

In order to improve locking of the pin, the pin 3 is formed with a laterally undulating or wavy configuration, thereby locking it by bearing against the side walls of channel 6 and the apertures 4 and 7.

In the example shown, pin 3 is formed with five waves: the three central waves leading to the pin resting and points 8, 9 and 10 against the side walls of channel 6; and the end waves leading to the pin resting, in opposition, at points 11 and 12, against the side walls of apertures 4 and 7.

Points 8, 9 and 10 enhance pin locking in the channel 6; support points 11 and 12 restrain the tooth 2 laterally in order to avoid side sliding of the tooth during work, such a sliding movement being due to a clearance 13 which has to be provided in order to obtain a good fit of tooth 2 on nose 5.

In the example shown, the pin 3 includes five waves at apexes 8, 9, 10, 11 and 12, but their number can be greater. In any case, their number should be at least three.

I claim:

1. A fixation device for a hollow removable wear-resisting tooth, said tooth having first and second apertures formed therein and each said aperture having side walls, said tooth being disposed on a nose portion of a support member having a curved channel formed therein having side walls, and wherein said device comprises:

a resilient curvilinear pin having at least three side waves and fitted within said curved channel and extending through said first and second apertures such that said at least three side waves enhance locking of said pin in position wherein said tooth and said support each comprise first and second laterally disposed opposing side walls, wherein said channel comprises a front wall and a rear wall, wherein said walls of said first and second apertures and said side walls of said channel each comprise first and second laterally disposed opposing side walls substantially parallel with said first and second side walls of said tooth and of said support, wherein said pin comprises a crescent-shaped cross section contacting said front wall of said channel without contacting said rear wall of said channel so as to maintain said tooth in position, and wherein said side waves of said pin are transversely disposed between and resiliently contacting said first and second laterally disposed opposing side walls of said first and second apertures and of said channel so as to maintain said pin within said channel and so as to avoid sideward sliding of said hollow tooth on said nose of said support upon operation of said tooth.

2. A device accordin to claim 1 wherein said at least three side waves further comprises a first, a second, a third, a fourth, and a fifth side wave each having a central apex, wherein said second, third and fourth side waves bear against said side walls of said channel and wherein said first and fifth side waves are disposed on opposing ends of said pin and respectively bear in opposition against said side walls of said first and said second aperture formed in said tooth so as to avoid sideward sliding of said hollow tooth on said nose of said support upon operation of said tooth.

* * * * *